US009608326B2

(12) United States Patent
Singh et al.

(10) Patent No.: US 9,608,326 B2
(45) Date of Patent: Mar. 28, 2017

(54) CIRCULAR POLARIZED ISOLATED MAGNETIC DIPOLE ANTENNA

(71) Applicant: Ethertronics, Inc., San Diego, CA (US)

(72) Inventors: Abhishek Singh, San Diego, CA (US); Jeffrey Shamblin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 78 days.

(21) Appl. No.: 14/660,741

(22) Filed: Mar. 17, 2015

(65) Prior Publication Data

US 2015/0311600 A1 Oct. 29, 2015

Related U.S. Application Data

(60) Provisional application No. 61/955,165, filed on Mar. 18, 2014.

(51) Int. Cl.

| | |
|---|---|
| ***H01Q 9/18*** | (2006.01) |
| ***H01Q 5/364*** | (2015.01) |
| ***H01Q 7/00*** | (2006.01) |
| ***H01Q 9/26*** | (2006.01) |
| ***H01Q 21/24*** | (2006.01) |
| *H01Q 1/42* | (2006.01) |
| *H01Q 1/38* | (2006.01) |
| *H01Q 21/30* | (2006.01) |

(52) U.S. Cl.

CPC ..... *H01Q 5/364* (2015.01); *H01Q 7/00* (2013.01); *H01Q 9/265* (2013.01); *H01Q 21/245* (2013.01); *H01Q 1/38* (2013.01); *H01Q 1/42* (2013.01); *H01Q 21/30* (2013.01)

(58) Field of Classification Search

CPC ..... H01Q 1/42; H01Q 9/18; H01Q 21/28

See application file for complete search history.

(56) References Cited

U.S. PATENT DOCUMENTS

| | | | | |
|---|---|---|---|---|
| 4,479,127 | A * | 10/1984 | Barbano | H01Q 1/38 343/700 MS |
| 4,933,680 | A * | 6/1990 | Shapiro | H01Q 3/22 342/368 |
| 5,173,711 | A * | 12/1992 | Takeuchi | H01Q 9/0421 343/700 MS |
| 6,486,853 | B2 | 11/2002 | Yoshinomoto | |
| 6,919,859 | B2 | 7/2005 | McCarthy | |
| 8,390,526 | B1 * | 3/2013 | O'Connell | H01Q 3/2617 343/790 |
| 2010/0177014 | A1 | 7/2010 | Min | |

* cited by examiner

*Primary Examiner* — Hoang V Nguyen

(74) *Attorney, Agent, or Firm* — Coastal Patent Law Group, P.C.

(57) ABSTRACT

A circularly polarized isolated magnetic dipole (CP-IMD) antenna includes: a first isolated magnetic dipole (IMD) element; a second IMD element positioned adjacent to the first IMD element; a third IMD element positioned adjacent to the second IMD element and configured to oppose the first IMD element; a fourth IMD element disposed positioned adjacent to each of the first and third IMD elements and configured to oppose the second IMD element; and a feed network configured to supply signals to the first thru fourth IMD elements at a phase difference of ninety degrees in a clockwise or counterclockwise direction.

8 Claims, 9 Drawing Sheets

M-Type Isolated Magnetic Dipole (IMD) Element

CIRCULAR POLARIZED ISOLATED MAGNETIC DIPOLE ANTENNA

CROSS-REFERENCE TO RELATED APPLICATIONS

This application claims benefit of priority with U.S. Provisional Ser. No. 61/955,165, filed Mar. 18, 2014, titled "CIRCULAR POLARIZED ISOLATED MAGNETIC DIPOLE ANTENNA"; the contents of which are hereby incorporated by reference.

BACKGROUND

Field of the Invention

This invention relates to antennas for wireless communications; and more particularly, to a circular polarized antenna with four isolated magnetic dipole elements disposed one adjacent to another about a square column substrate.

Description of the Related Art

A Square Quadrifilar Helical Antenna (S-QHA) is described in US 2010/0177014, published Jul. 15, 2010; hereinafter referred to as an "SQH Antenna"; the contents of which are hereby incorporated by reference.

The SQH Antenna provides a convenient manufactured device capable of receiving circular polarized signals for satellite communications. Manufacturing of the SQH Antenna is simple, and low-cost, which is a significant benefit in the industry. However, the SQH Antenna is not without complications, but instead is rather limited in terms of signaling efficiency and other performance characteristics.

It would be well received in the art to provide an improved antenna possessing the manufacturing benefits of the SQH Antenna, while enhancing performance characteristics associated with the antenna.

SUMMARY

A circularly polarized isolated magnetic dipole (CP-IMD) antenna is described.

The CP-IMD antenna generally comprises: a first isolated magnetic dipole (IMD) element; a second IMD element positioned adjacent to the first IMD element; a third IMD element positioned adjacent to the second IMD element and configured to oppose the first IMD element; a fourth IMD element disposed positioned adjacent to each of the first and third IMD elements and configured to oppose the second IMD element; and a feed network configured to supply signals to the first thru fourth IMD elements at a phase difference of ninety degrees in a clockwise or counterclockwise direction.

Other features and advantages will be recognized by those with skill in the art upon a thorough review of the following descriptive examples and detailed embodiments.

DETAILED DESCRIPTION

Figure 1:
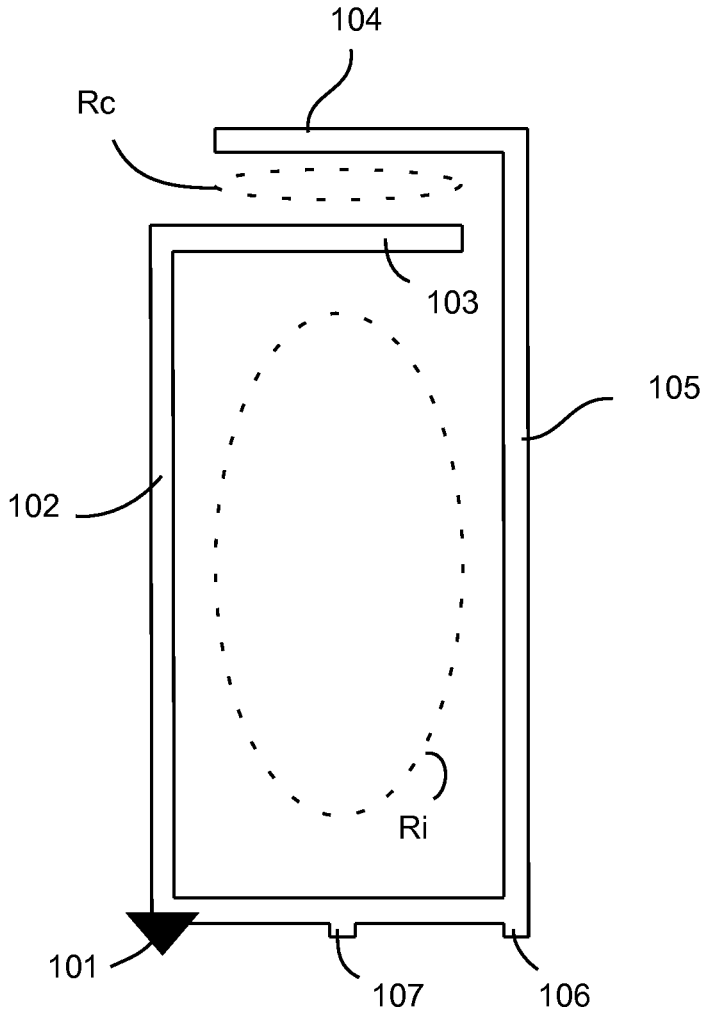
FIG. 1 (Prior Art)
FIG. 1 shows an m-type isolated magnetic dipole (IMD) antenna element.

In the following description, for purposes of explanation and not limitation, details and descriptions are set forth in order to provide a thorough understanding of the present invention in accordance with an illustrated embodiment. However, it will be apparent to those skilled in the art that the present invention may be practiced in other embodiments that depart from these details and descriptions without departing from the spirit and scope of the invention. An illustrated embodiment will be described below with reference to the drawings wherein illustrative features are denoted by reference numerals.

As used herein, the term "isolated magnetic dipole" (IMD) antenna element is generally a dipole conductor arranged with a portion of a first terminal end configured to overlap with a portion of a second terminal end thereof, forming a loop portion with a corresponding inductive reactance, and a capacitive region with a corresponding capacitive reactance, resulting in improved isolation of the antenna from nearby components. Examples of IMD elements can be referenced in commonly owned U.S. Pat. Nos. 7,084,813; 7,777,686; 8,421,702; and 7,932,869; the contents of each of which are hereby incorporated by reference.

FIG. 1 shows an "M-Type Isolated Magnetic Dipole" antenna element (M-IMD). The M-IMD comprises a bent conductor having a first vertical portion 102 extending from an bottom conductor to a first distal end and a first horizontal portion 103 extending from the first vertical portion 102 at the first distal end to a first terminus. The bent conductor further comprises a second vertical portion 105 extending vertically from the bottom conductor to a second distal end and a second horizontal portion 104 extending from the second vertical portion 105 at the second distal end to a second terminus. The first and second horizontal portions 103; 104, respectively, are configured to overlap with one another to form a capacitive region $R_c$ there between. The bottom conductor comprises a feed point 101, and ground points 106; 107 for coupling with a transceiver. The first vertical portion 102, first horizontal portion 103, second horizontal portion 104, second vertical portion 105, and bottom conductor collectively form a loop about which an inductive region $R_i$ is created. Thus, the IMD comprises a bent dipole forming each of a capacitive region and an inductive region configured with a corresponding reactance of the antenna sufficient to isolate the element from surrounding components.

Although the M-IMD element is illustrated, the invention may be practiced by incorporating any isolated magnetic dipole element in place of the M-type IMD element, or a combination of IMD elements.

The M-IMD can be tuned to vary a frequency response of the antenna by changing the distance of a gap between overlapping horizontal portions, or by elongating or reducing the amount or length overlap of horizontal portions. The idea is that more or less capacitance can be implemented between the horizontal portions for tuning the antenna element to a desired frequency.

Figure 2A:
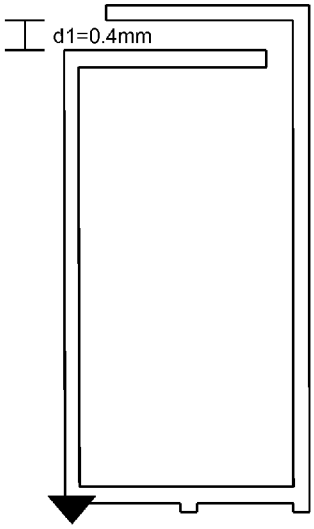
FIG.2A (Prior Art)
FIGS. 2 (A-C) show a method for tuning the m-type IMD element, with a gap between portions of the IMD being varied to adjust the signal as indicated in the accompanying diagram.
Figure 2B:
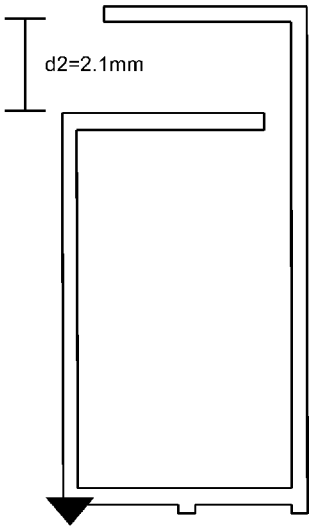
FIG.2B (Prior Art)
Figure 2C:
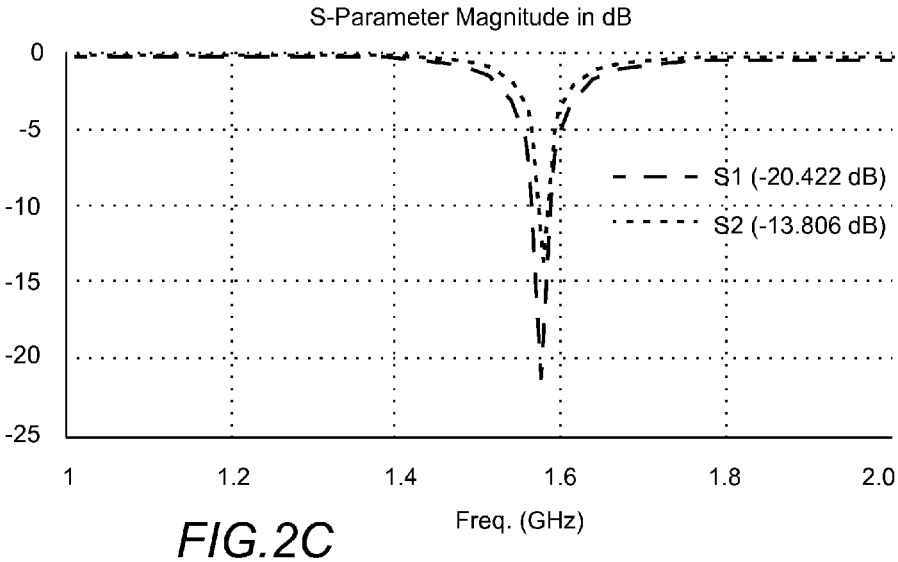
FIG.2C (Prior Art)

FIG. 2A shows a first M-IMD element having a gap distance d1=0.4 mm between horizontal portions thereof FIG. 2B shows a similar M-IMD antenna having a gap distance d2=2.1 mm between horizontal portions. FIG. 2C illustrates the resulting signal parameter for each element.

Additionally, the size of ground can be used to vary the frequency response of the antenna in accordance with known methods.

Figure 3A:
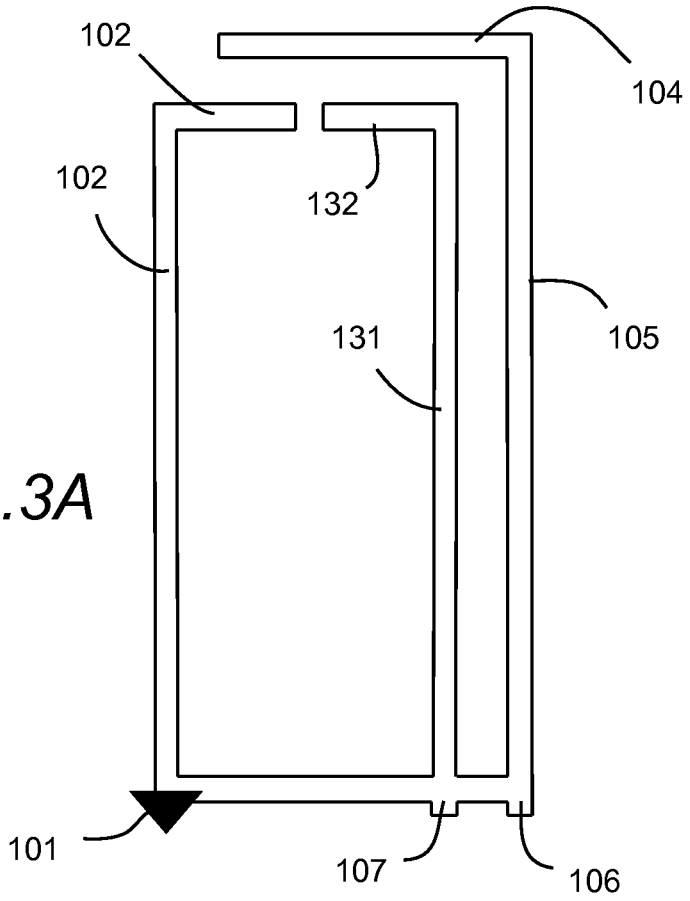
FIGS. 3 (A-B) show an m-type IMD element with a parasitic element configured to produce a dual frequency response as indicated in the accompanying diagram.
Figure 3B:
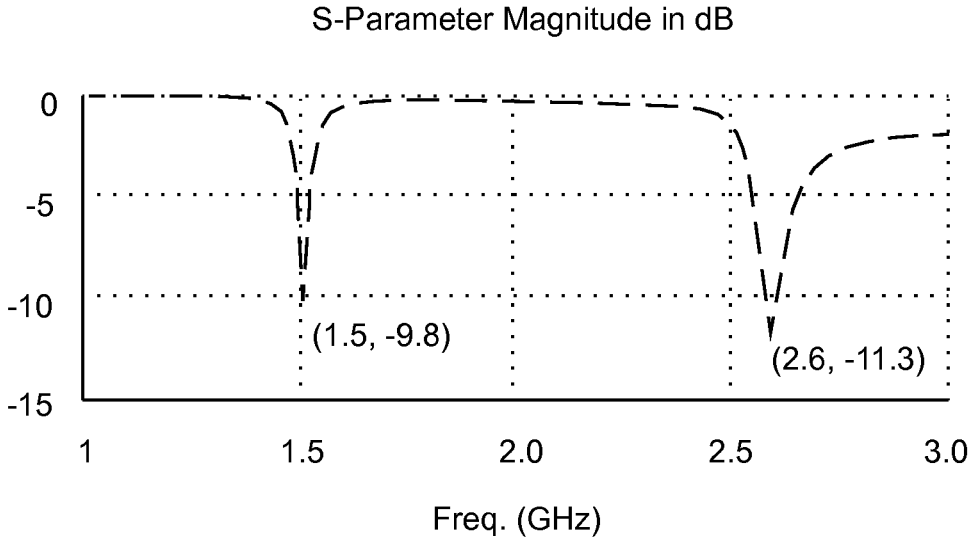

FIG. 3A shows another variation of the M-IMD comprising a parasitic element coupled to one of the ground points 107. The parasitic element comprises a vertical portion 131 and a horizontal portion 132 positioned within the M-IMD volume. The parasitic element functions to create a split frequency response as illustrated in FIG. 3B. In this regard, the illustrated M-IMD element is configured for dual frequency operation.

Other IMD elements can be incorporated depending on the desired application.

With each of the IMD antennas tuned to a desired frequency, or multiple frequencies, one can produce four IMD antennas for incorporating into a circularly polarized isolated magnetic dipole assembly as described herein.

In general, a circularly polarized isolated magnetic dipole antenna (CP-IMD antenna) comprises a first isolated magnetic dipole (IMD) element; a second IMD element positioned adjacent to the first IMD element; a third IMD element positioned adjacent to the second IMD element and configured to oppose the first IMD element; and a fourth IMD element disposed positioned adjacent to each of the first and third IMD elements and configured to oppose the second IMD element; and a feed network configured to supply signals to the first thru fourth IMD elements at a phase difference of ninety degrees in a clockwise or counterclockwise direction.

The use of isolated magnetic dipole elements provides several benefits, including: each of the four adjacent IMD elements is disposed on one of four sides of the antenna, providing better isolation and improved manufacturing; and each of the IMD elements is inherently configured for improved isolation between adjacent elements. These benefits result in an improved antenna performance over prior art circularly polarized antennas.

In one embodiment, a CP-IMD antenna assembly is manufactured to comprise each of: a square column substrate extending from a bottom end to a top end thereof and having a first side through a fourth side each adjacently disposed about an external surface of the column; a first antenna plate comprising a planar substrate and a first isolated magnetic dipole (IMD) element disposed on at least one planar surface thereof, a second antenna plate, a third antenna plate, and a fourth antenna plate; each of the first through fourth antenna plates being separately disposed on one of said first thru fourth sides of the column; and four dielectric insulators each being disposed above one of the first thru fourth antenna plates and configured to cover the respective IMD elements; wherein each of the antenna plates is disposed between a respective side of the column and a corresponding dielectric insulator; and wherein the assembly is housed within a cylindrical cover. The antenna and manufacturing method are illustrated and described herein.

Each of the four antenna plates can comprise an IMD antenna element, the four IMD elements being positioned about the square column for providing enhanced isolation between adjacent elements.

Each of the four IMD elements, respectively, can be individually confined to a single side of the square substrate.

In another embodiment, the first and third IMD elements are each positioned on a first pair of opposing sides of the square column, and the first and third IMD elements are tuned to a first frequency. The second and fourth IMD elements are each positioned on a second pair of opposing sides of the square column, and the second and fourth IMD elements are tuned to a second frequency that is slightly distinguished from the first frequency. This results in improved isolation between the adjacent IMD elements and improves the radiation efficiency of the structure.

In another embodiment, the first through fourth IMD elements are each tuned to a slightly distinguished frequency. In this regard, the first IMD element is tuned to a first frequency, the second IMD element is tuned to a second frequency slightly higher than the first frequency, the third IMD element is tuned to a third frequency slightly higher than the second frequency, and the fourth IMD element is tuned to a fourth frequency slightly higher than the third frequency. Thus, the antenna comprises a slight increase in frequency from one element to the next around a perimeter of the antenna, resulting in an increase in return loss and/or axial ratio bandwidth.

In yet another embodiment, the antenna is configured to generate a dual resonance from each of the four IMD elements about the antenna for providing a dual frequency circular polarized antenna.

Now turning to the drawings, the CP-IMD antenna will be described with reference to a preferred embodiment as illustrated in FIGS. 4A-9.

Figure 4A:
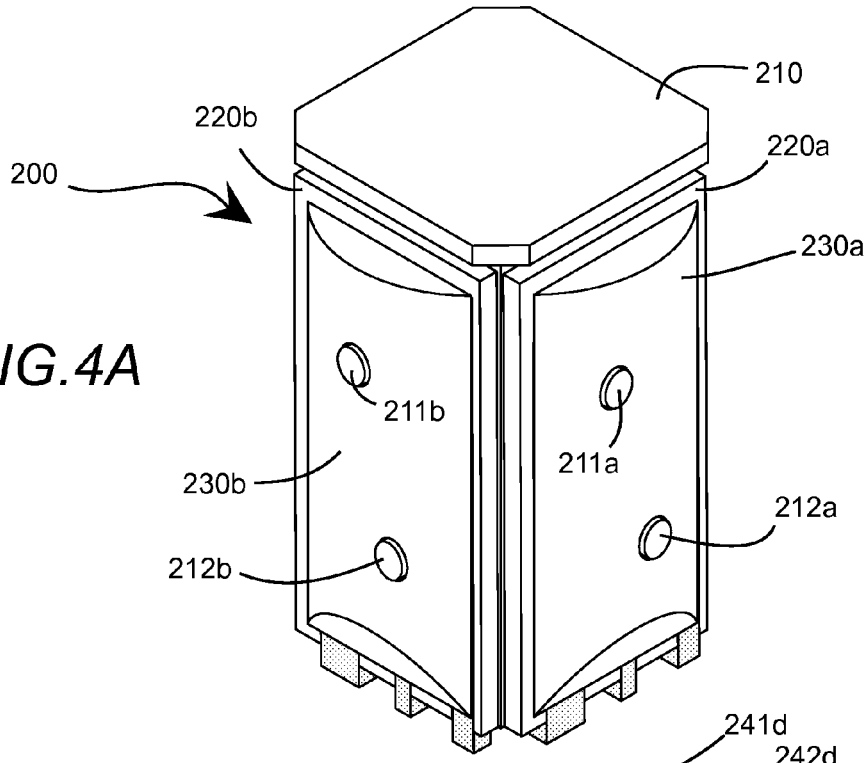
FIGS. 4 (A-C) illustrate a circularly polarized IMD antenna, including an antenna assembly, a feed network, and an schematic of the feed network, respectively.
Figure 4B:
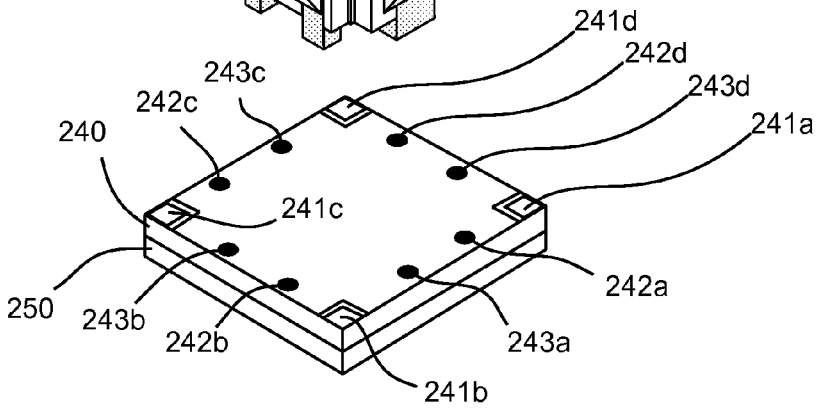
Figure 4C:
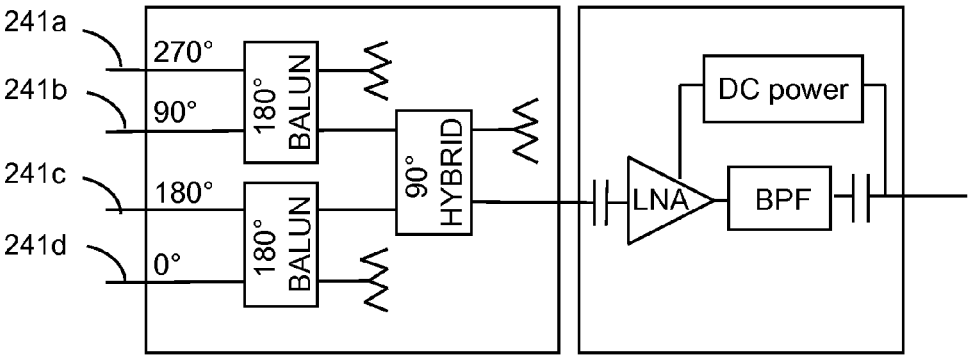

FIG. 4A shows a CP-IMD antenna assembly 200 in accordance with the illustrated embodiment, the assembly comprising a square column substrate 210 extending from a bottom end to a top end along a column axis. Each of four respective antenna plates 220*a;* 220*b* is coupled to one of four sides of the square column substrate. Each of four respective covers 230*a*; 230*b* are positioned above the respective antenna plates for covering the conductor portions of each IMD antenna disposed on the antenna plates. The substrate comprises protrusions 211*a*; 212*a;* 211*b;* 212*b* for engaging a respective aperture of each antenna plate and cover. The antenna module (substrate, antenna plates, and covers) is coupled to a feed network 240, and optionally a low noise amplification unit 250 as illustrated in FIG. 4B. The feed network comprises a plurality of feed points 241(*a-d*) and ground points 242(*a-d*); 243(*a-d*) configured to couple feed signals to each of the four IMD elements at phase differences of ninety degrees. The feed network 240 and optional low noise amplification unit 250 are each shown in FIG. 4C with corresponding circuitry.

Figure 5:
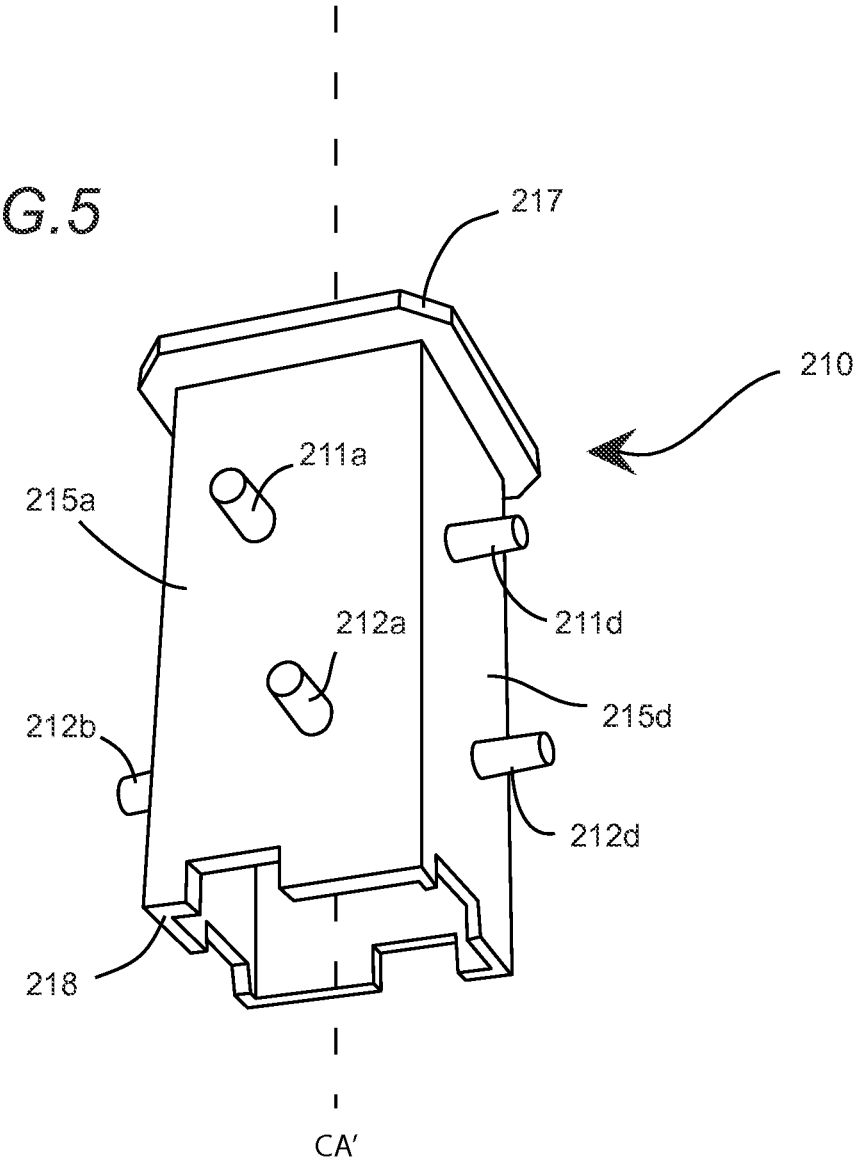
FIG. 5 shows a square column substrate used in accordance with an illustrated embodiment.

To further illustrate a preferred embodiment, the substrate 210 is further shown in FIG. 5, and comprises: a square column having four planar sides 215*a;* 215*b* adjacently disposed about a column axis (CA'); a pair of protrusions 211*a*-212*a;* 211*b*-212*b* disposed on each of the respective four sides of the substrate; a top end 217 and a bottom end 218. Although shown with notches along the bottom edge of the substrate, this feature is merely optional, but can be used to provide additional attachment benefits with a feed network circuit printed on a pc board configured to engage with the respective notches.

Figure 6A:
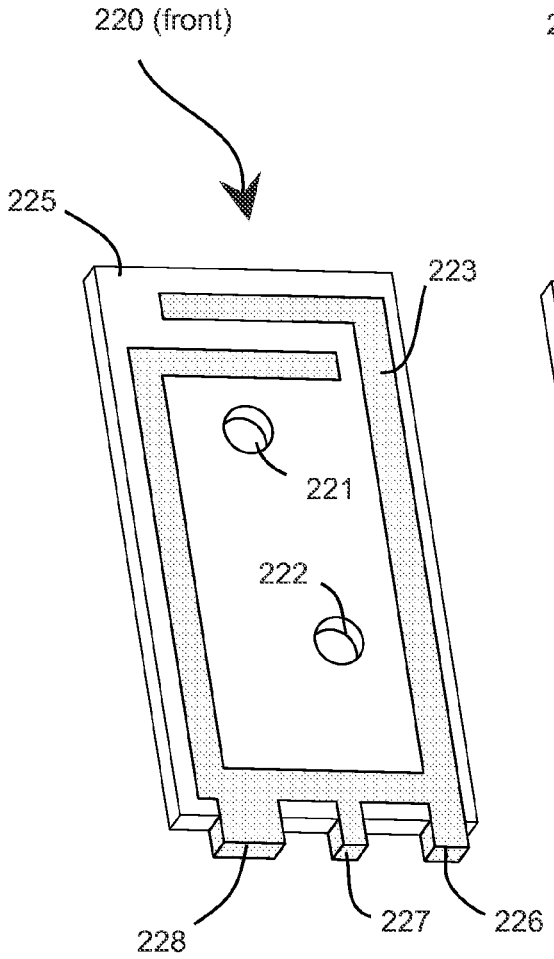
FIGS. 6 (A-B) show front and rear sides of an IMD element disposed on a plate for use in accordance with the illustrated antenna assembly.
Figure 6B:
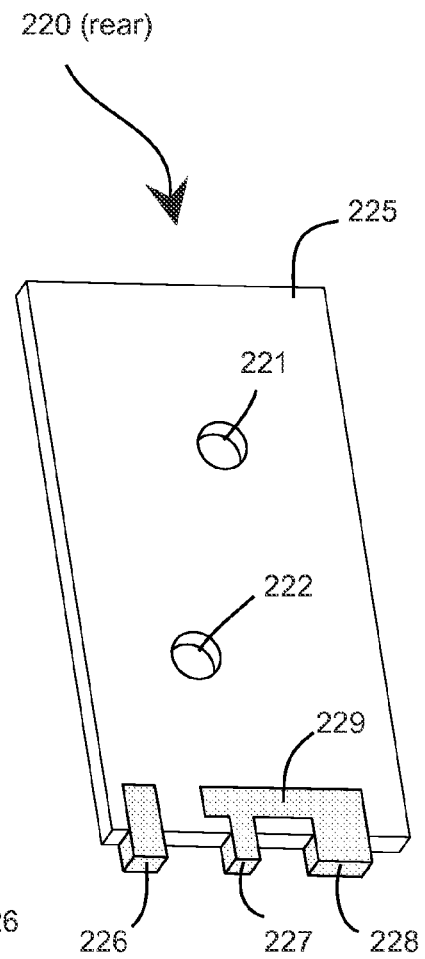

FIG. 6A shows the front side of an antenna plate 220 having an IMD element 223 coupled to a surface thereof. The IMD element can be plated, printed, or otherwise coupled to the plate in accordance with any known method. The plate may comprise a ceramic, dielectric substrate, or similar non-conductive planar volume. The antenna plate further comprises a pair of apertures 221, 222 configured to engage the corresponding protrusions of the substrate. Neat a bottom end of the antenna plate reside a feed 226 and ground connections 227; 228. FIG. 6B shows a rear side of the IMD antenna plate. A bridge conductor 229 couples the ground points 227; 228.

Figure 7A:
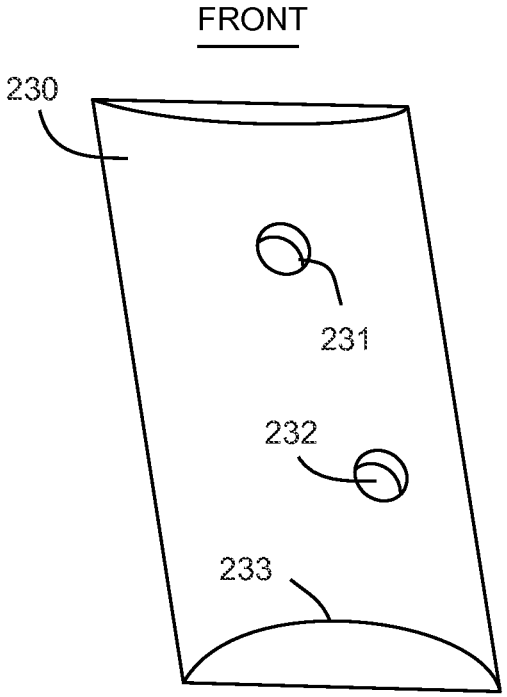
FIGS. 7 (A-B) shows front and rear sides of a cover for use in accordance with the illustrated antenna assembly.
Figure 7B:
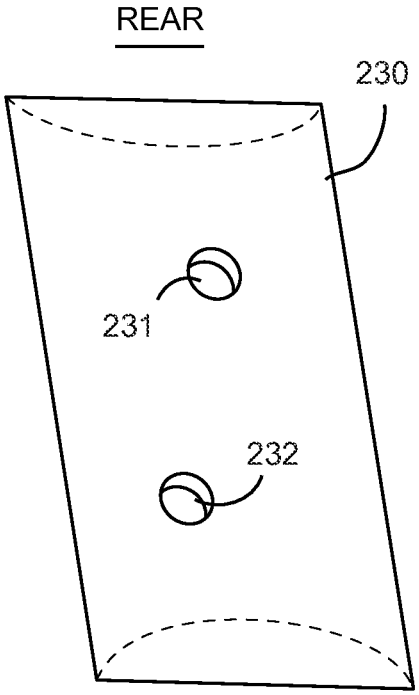

Covers are illustrated in FIGS. 7(A-B). FIG. 7A shows a front side of a cover 230 having a rounded volume 233 for receiving a cylindrical cover (see FIG. 9). The cover further comprises a pair of apertures configured to receive the protrusions of the square column substrate. FIG. 7B shows a rear side of the cover. Four covers are used to protect the conductive elements of four respective antenna plates; each of which being positioned on one of the four sides of the square column substrate.

Figure 8:
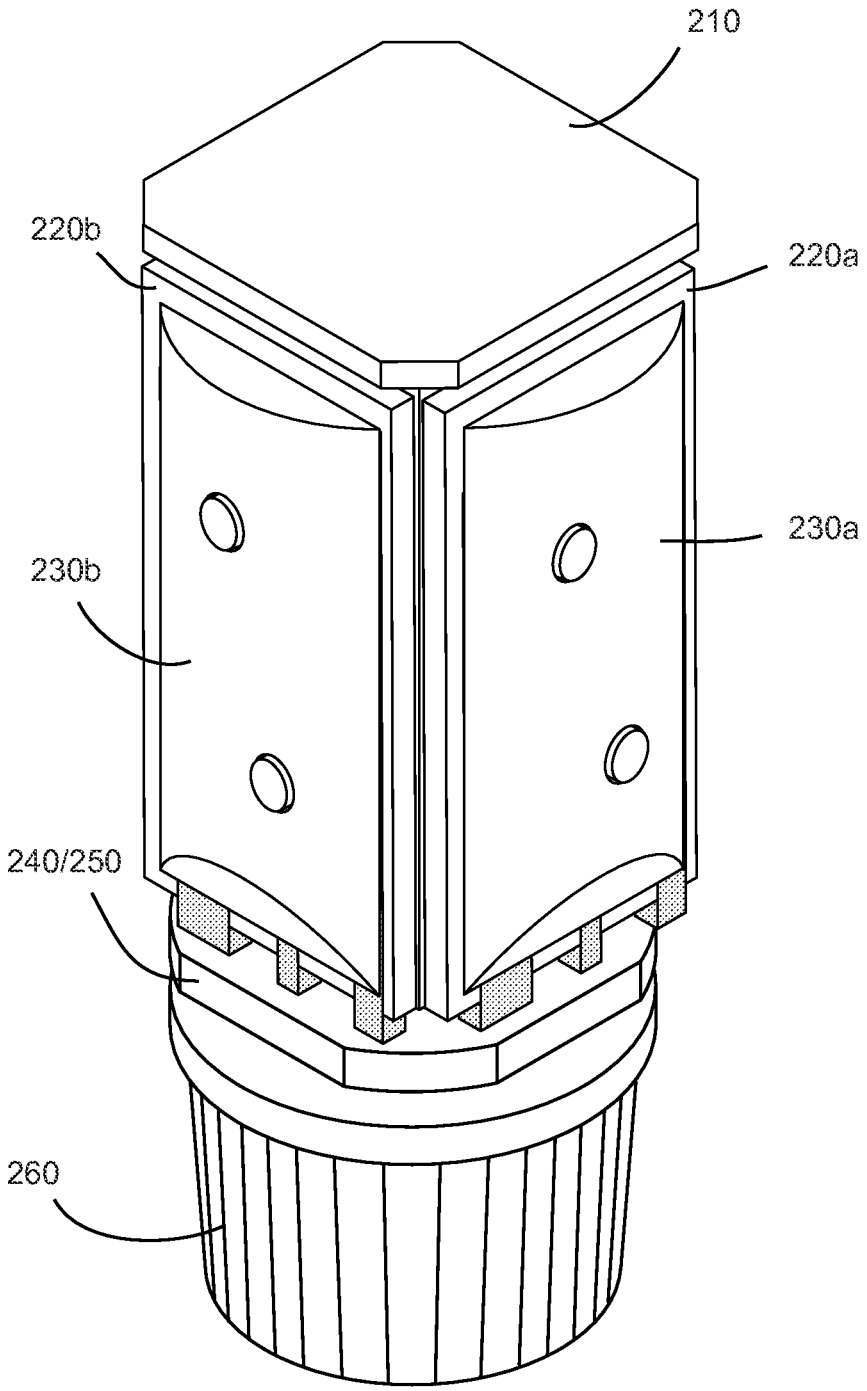
FIG. 8 shows an antenna assembly in accordance with the illustrated embodiment.

FIG. 8 shows the antenna assembly coupled to the feed network circuit and optional low pass amplification unit 240/250 (here a PC board); and further coupled to an SMA connector 260. The assembly is shown with a square column substrate 210 having four adjacent sides; four antenna plates 220*a;* 220*b* (two of which are visible) coupled to respective sides of the substrate; and four covers 230*a;* 230*b* each positioned above a respective antenna plate (two of which are visible in the drawing). The assembled antenna is ready for final packaging and use with a transceiver.

Figure 9:
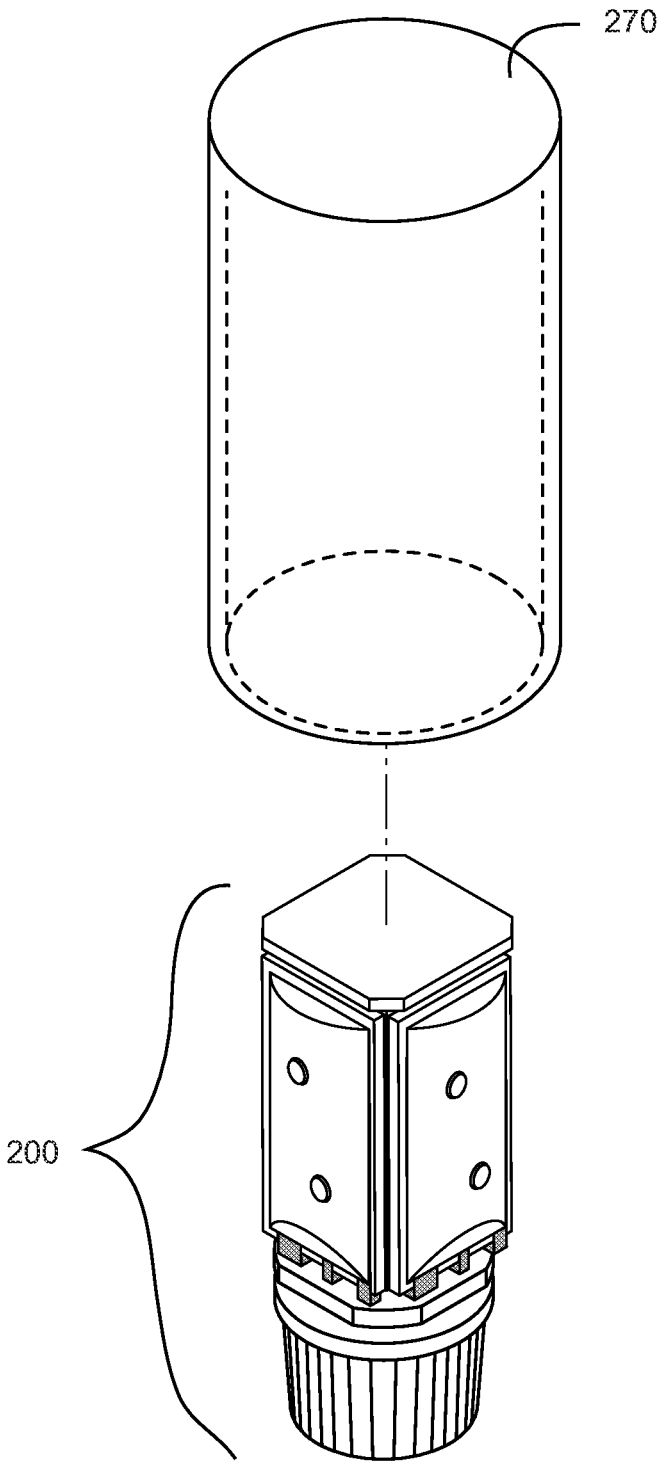
FIG. 9 shows the antenna assembly with a cover for protecting the assembly components.

FIG. 9 shows a completed CP-IMD antenna ready for use. The CP-IMD antenna may further comprise a hollow cylindrical cover for protecting the assembly components.

In the CP-IMD antenna, variations may be produced which have resulting distinct benefits. For example, in an embodiment, the first IMD element and third IMD element, which are configured to oppose one another, may be tuned to a first frequency using any of the methods discussed above. Similarly, the second and fourth IMD elements, which are also configured to oppose one another, may be tuned to a second frequency slightly distinct from the first frequency. In this embodiment, it becomes feasible to expand either or both the return loss bandwidth or axial ratio bandwidth.

In another variation, each of the first thru fourth adjacent elements can be tuned to a slightly distinct and increased frequency beginning with the first element thru the fourth element about the antenna. This embodiment has been shown to result in increased return loss and/or axial ratio bandwidth.

In yet another varied embodiment, each of the four respective IMD elements can be tuned to produce a dual frequency response. The resulting CP-IMD antenna will provide a dual-frequency circular polarization.

A particularly beneficial application for the CP-IMD antenna includes the global positioning system (GPS) application. GPS frequencies include at least: 1575 MHz; 1227 MHz; and 1381 MHz; however others can be implemented depending on the desired application. Although GPS is a useful application, it should be recognized that other frequencies, and multiple frequencies, can be tuned for use within the CP-IMD antenna.

In another embodiment, it is possible to use two CP-IMD antenna elements and place them opposite to each other on the first and third face of a square substrate. These elements can be used to generate circular polarization.

In another embodiment, it is possible to use two CP-IMD antenna elements that are placed adjacent to each other on either the first and second face or the first and fourth face of the square substrate and fed 90 degree out of phase to produce Right Hand or Left Hand Circular Polarization respectively.

The invention claimed is:

1. A structure of a circularly polarized isolated magnetic dipole antenna, comprising:

a square column substrate extending along a length and having four sides thereof including a first side, a second side adjacent to the first side, a third side adjacent to the second side, and a fourth side adjacent to each of the third side and the first side;

a first antenna plate having a first isolated magnetic dipole (IMD) element disposed on at least one surface thereof, the first antenna plate being attached to the square column at the first side;

a second antenna plate having a second IMD element disposed on at least one surface thereof, the second antenna plate being attached to the square column at the second side;

a third antenna plate having a third IMD element disposed on at least one surface thereof, the third antenna plate being attached to the square column at the third side;

a fourth antenna plate having a fourth IMD element disposed on at least one surface thereof, the fourth antenna plate being attached to the square column at the fourth side;

a first cover comprising a substantially planar volume configured to cover the first IMD element;

a second cover comprising a substantially planar volume configured to cover the second IMD element;

a third cover comprising a substantially planar volume configured to cover the third IMD element;

a fourth cover comprising a substantially planar volume configured to cover the fourth IMD element;

a feed network configured to supply signals to the first thru fourth IMD elements at a phase difference of ninety degrees in a clockwise or counterclockwise direction; and a cylindrical cover adapted to nest over the antenna plates attached to the substrate;

wherein each of said first thru fourth IMD elements is individually tuned to one of four distinct frequencies; and wherein said first IMD element is tuned to a first frequency, and each of said second thru fourth IMD elements is tuned to a progressively increased frequency with respect to the first frequency such that frequency increases incrementally from the first IMD element to the fourth IMD element about the antenna.

2. The antenna of claim 1 further comprising an SMA connector for coupling the antenna and a transceiver circuit.

3. A structure of a circularly polarized isolated magnetic dipole antenna, comprising:

a square column substrate extending along a substrate axis from a bottom end to a top end, the substrate having four planar sides each disposed parallel with the substrate axis, the four sides consisting of a first side, a second side adjacent to the first side, a third side adjacent to the second side, and a fourth side adjacent to each of the first and third sides;

a first isolated magnetic dipole (IMD) element disposed on the first side;

a second IMD element disposed on the second side;

a third IMD element disposed on the third side;

a fourth IMD element disposed on the fourth side;

a feed network configured to supply signals to the first thru fourth IMD elements at a phase difference of ninety degrees in a clockwise or counterclockwise direction.

wherein each of said first thru fourth IMD elements is individually tuned to a distinct frequency; and wherein each of said first thru fourth IMD elements is configured to produce a dual frequency response resulting in a dual frequency circularly polarized IMD antenna.

4. A structure of a circularly polarized isolated magnetic dipole antenna, comprising:

a first isolated magnetic dipole (IMD) element;

a second IMD element positioned adjacent to the first IMD element;

a third IMD element positioned adjacent to the second IMD element and configured to oppose the first IMD element; and a fourth IMD element disposed positioned adjacent to each of the first and third IMD elements and configured to oppose the second IMD element; and a feed network configured to supply signals to the first thru fourth IMD elements at a phase difference of ninety degrees in a clockwise or counterclockwise direction.

wherein each of said first thru fourth IMD elements is individually tuned to one of four distinct frequencies; and wherein said first IMD element is tuned to a first frequency, and each of said second thru fourth IMD elements is tuned to a progressively increased frequency with respect to the first frequency such that frequency increases incrementally from the first IMD element to the fourth IMD element about the antenna.

5. The antenna of claim 4, wherein said first and third IMD elements are each tuned to a first frequency; and wherein said second and fourth IMD elements are each tuned to a second frequency that is distinct from the first frequency for expanding at least one of: return loss bandwidth or axial ratio bandwidth and improving the radiation efficiency of the overall structure.

6. The antenna of claim 4, wherein each of said first thru fourth IMD elements is configured to produce a dual frequency response resulting in a dual frequency circularly polarized IMD antenna.

7. The antenna of claim 4, wherein each of the IMD elements is tuned to a frequency useful for communicating in the global positioning system (GPS).

8. A structure of a circularly polarized isolated magnetic dipole antenna, comprising:

a square column substrate extending along a length and having four sides thereof including a first side, a second side adjacent to the first side, a third side adjacent to the second side, and a fourth side adjacent to each of the third side and the first side;

a first antenna plate having a first isolated magnetic dipole (IMD) element disposed on at least one surface thereof, the first antenna plate being attached to the square column at the first side;

a second antenna plate having a second IMD element disposed on at least one surface thereof, the second antenna plate being attached to the square column at one of: the second side, the third side, or the fourth side;

a feed network configured to supply signals to the first thru fourth IMD elements at a phase difference of ninety degrees in a clockwise or counterclockwise direction; and a cylindrical cover adapted to nest over the antenna plates attached to the substrate;

wherein each of said first and second IMD elements is individually tuned to a distinct frequency; and wherein each of said first and second IMD elements is configured to produce a dual frequency response resulting in a dual frequency circularly polarized IMD antenna.

* * * * *